US009765462B2

(12) United States Patent
Park

(10) Patent No.: US 9,765,462 B2
(45) Date of Patent: Sep. 19, 2017

(54) DRUM TYPE WASHING MACHINE HAVING A DRYER THEREIN

(71) Applicant: Dongbu Daewoo Electronics Corporation, Seoul (KR)

(72) Inventor: Jong Won Park, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 363 days.

(21) Appl. No.: 14/156,223

(22) Filed: Jan. 15, 2014

(65) Prior Publication Data

US 2015/0176167 A1 Jun. 25, 2015

(30) Foreign Application Priority Data

Dec. 20, 2013 (KR) ..... 10-2013-0160687

(51) Int. Cl.
*D06F 25/00* (2006.01)
*D06F 58/04* (2006.01)
*D06F 37/26* (2006.01)

(52) U.S. Cl.
CPC ..... *D06F 25/00* (2013.01); *D06F 37/26* (2013.01); *D06F 58/04* (2013.01)

(58) Field of Classification Search
CPC ..... D06F 25/00; D06F 39/008; D06F 39/083; D06F 58/24; D06F 58/28
USPC ..... 68/20, 24, 19.2, 5 C, 58, 140, 19, 13 R, 68/139, 18 C, 18 R, 142; 34/596, 77, 34/138, 595; 8/158, 137
See application file for complete search history.

(56) References Cited

U.S. PATENT DOCUMENTS 2,913,832 A * 11/1959 Kaufman ..... D06F 58/02 34/597
2003/0089138 A1* 5/2003 Kawamura et al. .... D06F 25/00 68/17 R
2008/0244922 A1* 10/2008 Kim ..... D06F 58/26 34/134
2011/0271719 A1* 11/2011 Fujitsuka ..... D06F 23/02 68/134
2014/0033446 A1* 2/2014 Vander Zwaag ..... D06F 37/28 8/137

FOREIGN PATENT DOCUMENTS

JP 0884894 4/1996
KR 1020060035430 A 4/2006

* cited by examiner

*Primary Examiner* — David Cormier
*Assistant Examiner* — Thomas Bucci

(57) ABSTRACT

A drum type washing machine, including a cabinet having a vertical cross section with a quadrangular shape; a tub having one surface that faces one or more upper corners of the cabinet, and is adjacent to the cabinet; and a rotatable drum in the tub, and configured to hold or accommodate laundry, is disclosed.

6 Claims, 3 Drawing Sheets

DRUM TYPE WASHING MACHINE HAVING A DRYER THEREIN

CROSS-REFERENCE TO RELATED APPLICATIONS

This application is based on and claims priority from Korean Patent Application No. 10-2013-0160687, filed on Dec. 20, 2013, the disclosure of which is incorporated herein in its entirety by reference.

TECHNICAL FIELD

The present disclosure relates to a drum type washing machine, and more particularly, to a drum type washing machine capable of improving a drying efficiency and time for drying the laundry by improving a structure of a tub.

BACKGROUND

In general, a drum type washing machine refers to an apparatus that washes laundry by rotating a drum using drive power from a motor, when detergent, water, and laundry are placed in the drum. According to the drum type washing machine, clothes are hardly damaged or tangled. Washing the laundry by a drum type washing machine occurs by beating and rubbing the clothes in the washing machine.

With tendencies of improved functions and high-grade products, a demand for a drum type washing machine with a function for drying laundry, as well as functions for washing and spin-drying laundry, has increased.

The drum type washing machine with a dryer or other function for drying laundry (i) forcibly draws and heats external air using (a) a hot air providing device, such as a fan, a heater, and the like, that is installed outside a tub, and (b) a heating duct, and (ii) blows the high-temperature heated air into the tub to dry the laundry in a drum of the washing machine.

A drying rate and a drying time for laundry in the drum type washing machine having a drying function vary, depending on the area of the tub.

However, the tub of the drum type washing machine with a function for drying laundry generally has a coaxial structure together with the drum, and an external shape of the tub has a circular or cylindrical shape, like the shape of the drum.

Accordingly, an amount of high-temperature heated air that flows into the tub from the hot air providing device and the heating duct may be limited. As a result, a relatively long period of time is needed to dry the laundry.

Since a long period of time is needed to dry the laundry, excessive electrical power may be consumed, since the hot air providing device is continuously operated.

SUMMARY

The present disclosure has been made in an effort to provide a drum type washing machine capable of reducing electrical power consumption, and effectively improving a drying rate and a drying time for laundry in the washing machine.

Exemplary embodiments of the present disclosure provide a drum type washing machine including a cabinet having a vertical cross section with a quadrangular or substantially quadrangular shape; a tub having one surface that faces one or more upper corners of the cabinet, and is adjacent to the cabinet; and a rotatable drum in the tub, configured to hold or accommodate laundry.

The tub may have a first upper corner adjacent to the cabinet, and a second upper corner adjacent to the drum, and the drum type washing machine may further include a drying duct at the upper corner of the tub adjacent to the drum, configured to supply hot air to the tub.

The drum type washing machine may further include a hot air providing device configured to provide hot air to the drying duct.

An upper portion of the tub may have a volume greater than a volume of a lower portion of the tub, based on or relative to a rotation center of the drum.

According to exemplary embodiments of the present disclosure, the drum type washing machine may reduce electrical power consumption, and effectively improve a drying rate and a drying time for the laundry in the washing machine.

An interval or space between the drum and the tub may be widened or otherwise increased, thereby effectively reducing noise that may be caused during a spin-drying process.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
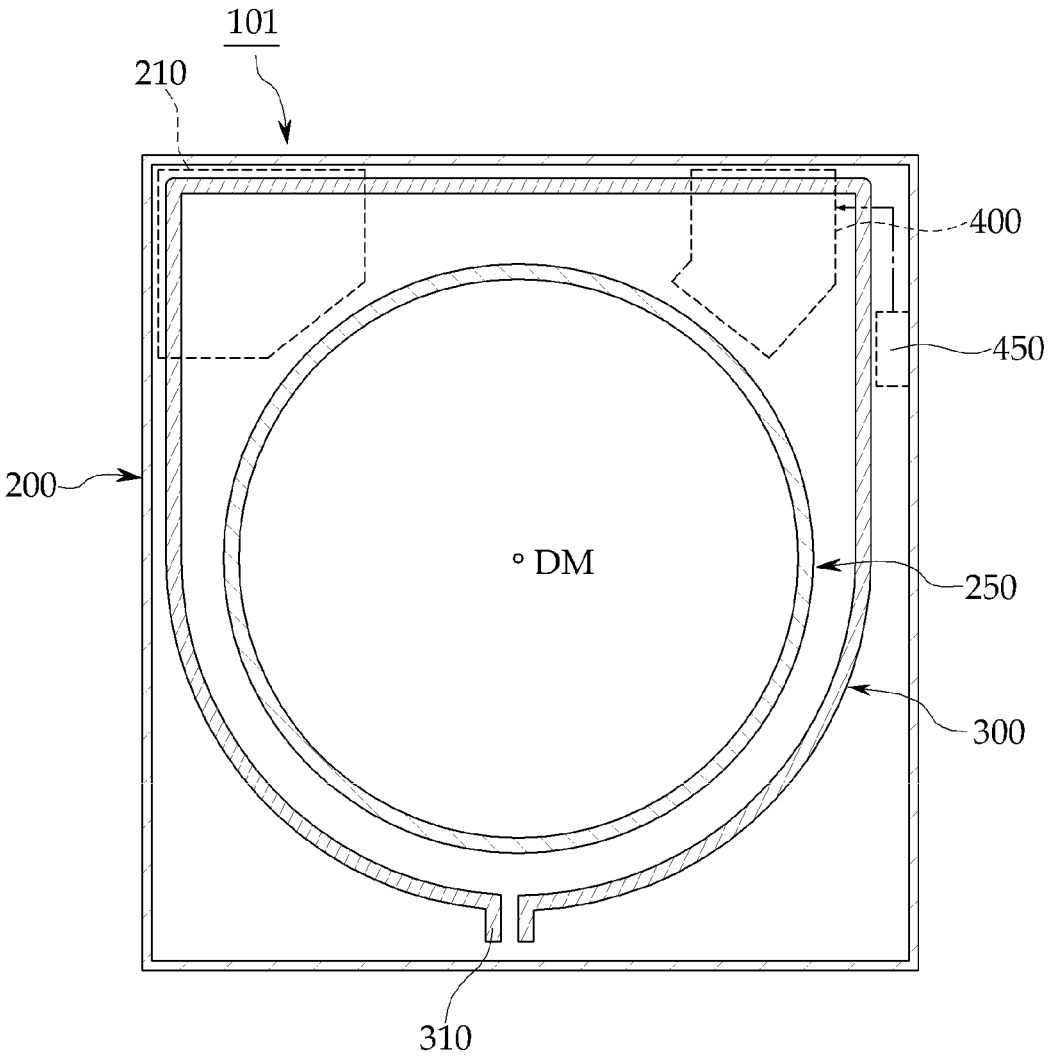
FIG. 1 is a configuration diagram of a drum type washing machine according to exemplary embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, exemplary embodiments of the present disclosure will be described in detail with reference to the accompanying drawings so that those skilled in the technical field to which the present disclosure pertains may carry out the exemplary embodiments. The present disclosure may be implemented in various different forms, and is not limited to the exemplary embodiments described herein.

The drawings are schematically illustrated, and the scales of the drawings are not necessarily identical to each other. Relative dimensions and ratios of the parts illustrated in the drawings may be exaggerated or reduced in terms of sizes thereof for clarification of the drawings and convenience, and any dimension is only illustrative, and is not necessarily limited thereto. The same structures, elements or components illustrated in two or more drawings are designated by the same reference numerals so as to illustrate the same or similar features.

Exemplary embodiments of the present disclosure are presented as idealized embodiments of the present disclosure. As a result, various modifications of the drawings are expected. The disclosed exemplary embodiments are not limited to the specific forms in certain regions illustrated in the drawings, and for example, include modifications of such forms by manufacturing.

Hereinafter, a drum type washing machine 101 according to exemplary embodiments of the present disclosure will be described with reference to FIGS. 1 and 2.

Figure 2:
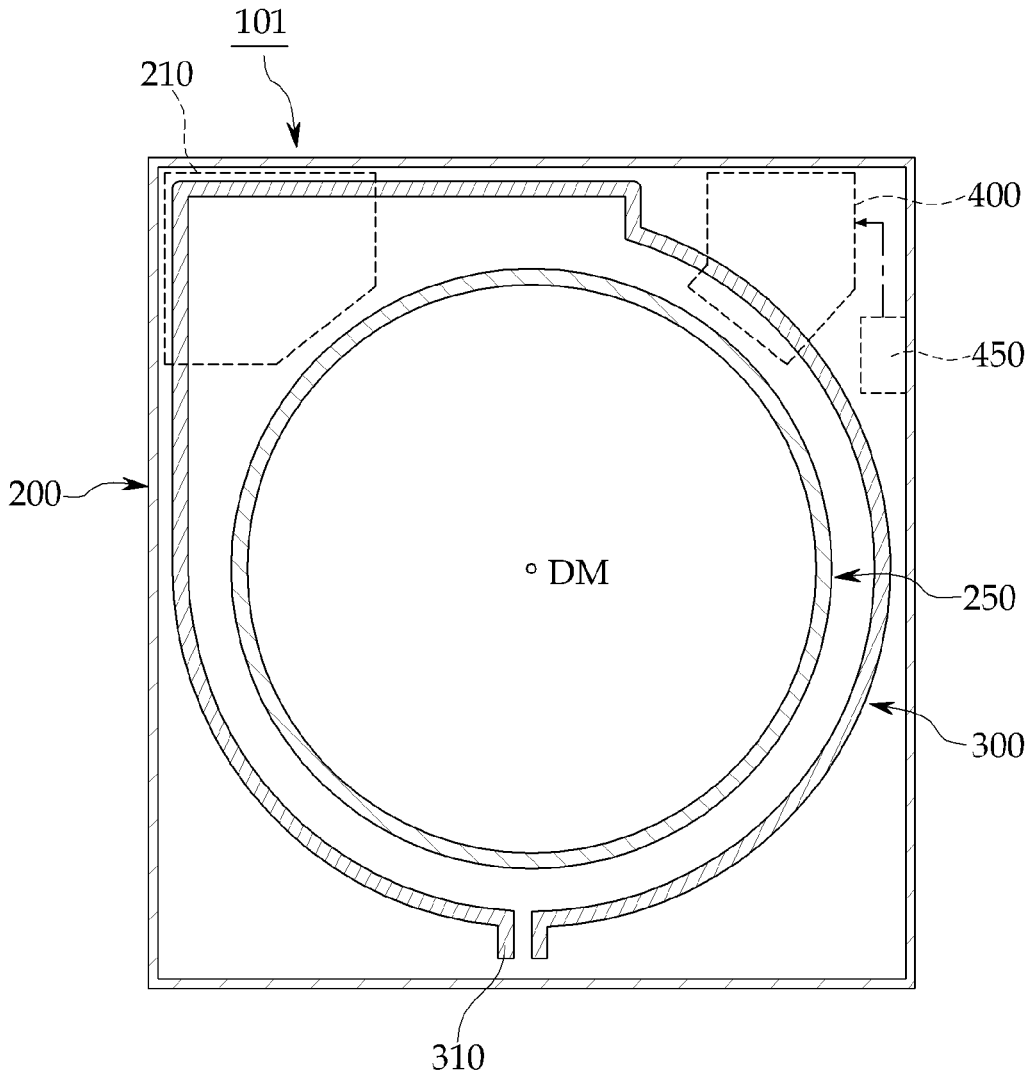
FIG. 2 is a configuration diagram of a drum type washing machine that includes a tub according to further exemplary embodiments.

As illustrated in FIGS. 1 and 2, the drum type washing machine 101 according to exemplary embodiments of the present disclosure includes a cabinet 200, a tub 300, and a drum 250.

The drum type washing machine 101 according to exemplary embodiment of the present disclosure may further include a drying duct 400 and a hot air providing device 450.

The cabinet 200 forms an external shape and/or appearance of the drum type washing machine 101, and houses, protects and/or provides mechanical and/or physical support for drive components for driving the drum type washing machine 101. A control panel (not illustrated) for controlling the drive components may be installed and/or mounted in an/or on the surface of the cabinet 200. In addition, a detergent storing and/or supply unit 210 for storing detergent and/or supplying detergent to the tub 300 and/or drum 250 may be in and/or accessible through the cabinet 200.

A vertical cross section of the cabinet 200 (e.g., a cross-section of the cabinet 200 from the uppermost surface or top to the lowermost surface or bottom, parallel with the front panel, back/rear panel, or side walls of the cabinet 200) may have a shape that is quadrangular or substantially quadrangular (e.g., with rounded corners, or relatively small extensions, protrusions or indentations). Accordingly, the cabinet 200 may have a rectangular or substantially rectangular parallelepiped shape. However, the present disclosure is not limited thereto.

The tub 300 is installed in the cabinet 200, and holds or stores water supplied by or from a water supply device (not illustrated).

The drum 250 is in the tub 300, is rotatable, and is configured to hold or accommodate laundry. Specifically, the drum 250 has a cylindrical or slightly conical shape, one open side or end (e.g., facing the front of the washing machine), and a plurality of holes therein, allowing water to flow into the drum 250 from the tub 300.

A shape of the tub 300 will be described in more detail with reference to FIGS. 1 and 2.

As illustrated in FIG. 1, an external or cross-sectional shape of an upper portion of the tub 300 is different from an external or cross-sectional shape of a lower portion of the tub 300. Specifically, the external or cross-sectional shape of the lower portion of the tub 300 may be cylindrical or semi-circular, and/or may correspond to the external or cross-sectional shape of the drum 250. The external or cross-sectional shape of the upper portion of the tub 300 may be quadrangular or substantially quadrangular, or have a horizontal or substantially horizontal central portion with vertical or substantially vertical sections at opposed ends of the central portion, or have a shape that corresponds to the external or cross-sectional shape of the cabinet 200.

Specifically, two or more corners or right-angled edges of the upper portion of the tub 300 may be adjacent or relatively adjacent to corresponding upper corners or edges of the cabinet 200, which has a vertical cross section having a quadrangular shape, in comparison with the drum 300.

Thus, at least two (and typically up to four) corners of the upper portion of the tub 300 are adjacent to corresponding upper corners of the cabinet 200.

As illustrated in FIG. 2, one or two corners or edges of the upper portion of the tub 300 may be adjacent to corresponding upper corner(s) or upper edge(s) of the cabinet 200, and one or more other corners, edges or surface(s) of the upper portion of the tub 300 may be adjacent to the drum 250.

The size and shape of the tub 300 may vary. A volume of the upper portion of the tub 300 and a volume of the lower portion of the tub 300 may be different from each other, based on or relative to a rotation center DM of the drum 250 (e.g., a horizontal plane that passes through the rotation center DM).

In various embodiments of the present disclosure, the drying duct 400 that supplies hot air into the tub 300 may be at, in and/or adjacent to one region of the upper portion of the tub 300.

The drying duct 400 is configured to communicate (e.g., be in gaseous communication) with the tub 300.

Specifically, when one or more upper corners or edges of the tub 300 is adjacent to the cabinet 200, and one ore more other corners or edges are adjacent to the drum 250, the drying duct 400 may be at, in and/or on one region or surface of the tub 300 adjacent to the drum 250.

In various embodiments, as previously discussed, the washing machine 101 may further include the hot air providing device 450 that provides hot air to the drying duct 400.

The hot air providing device 450 may be configured as a fan, a heater, a dryer, or the like, but is not particularly limited thereto, and may be configured as a device that generates hot air and/or heat and that is known to those skilled in the art.

The hot air providing device 450 may be positioned inside the drying duct 400 to supply hot air directly to the drying duct 400. Alternatively, the hot air providing device 450 may be positioned outside the drying duct 400 to provide hot air indirectly to the drying duct 400.

A water drain and/or pipe 310 is provided at a lower or lowermost end of the tub 300.

The water drain and/or pipe 310 discharges the water in the tub 300 to the outside of the cabinet 200 after the process of washing the laundry is completed. Although not illustrated, the drum type washing machine 101 according to exemplary embodiments of the present disclosure may further include a valve that adjusts the water draining operation through the water drain and/or pipe.

Figure 3:
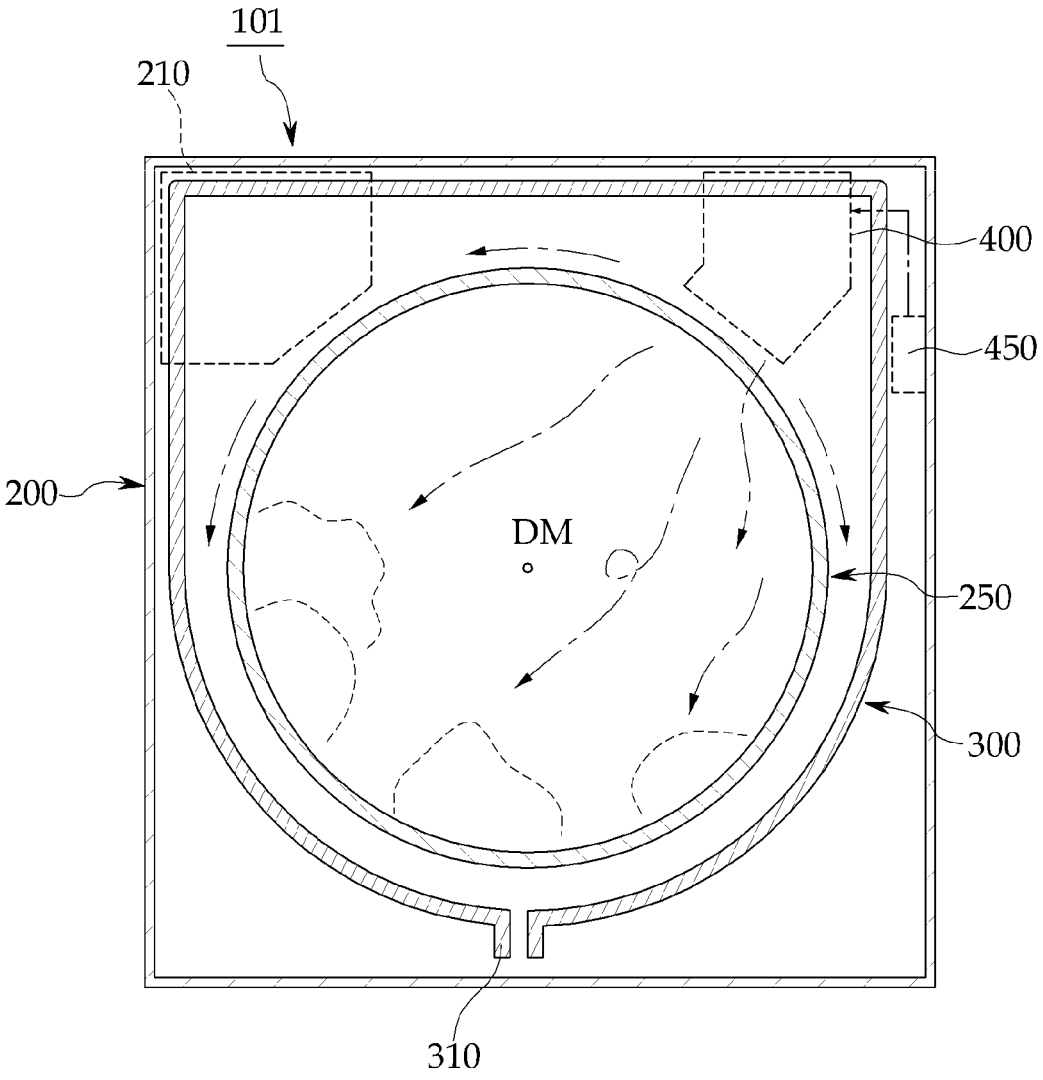
FIG. 3 is a configuration diagram illustrating the exemplary drum type washing machine of FIG. 1 during a washing operation.

Hereinafter, a drying operation of the drum type washing machine 101 according to exemplary embodiments of the present disclosure will be described with reference to FIG. 3.

The drum type washing machine 101 equipped with a function for drying laundry performs a process of drying the laundry after washing, draining, and spin-drying the laundry.

Hot air is provided to the drying duct 400 by the hot air providing device 450, then is supplied to the tub 300 through the drying duct 400. The hot air supplied to the drying duct 400 flows into the drum 250 by passing through the plurality of holes in the drum 250.

The hot air may be continuously supplied to the tub 300 from the hot air providing device 450 until the process of drying the laundry is completed, such that the hot air circulates in the drum 250 to dry the wet laundry.

With the aforementioned configuration, the drum type washing machine 101 according to exemplary embodiments of the present disclosure advantageously increases an amount of hot air that flows into the tub 300 from the drying duct 400, thereby effectively improving a drying rate and a drying time of the laundry in the drum type washing machine, and reduces unnecessary electrical power consumption.

Furthermore, the configuration of embodiments of the present disclosure provide a relatively larger and/or wider interval or space between the drum 250 and the tub 300 as compared to conventional drum type washing machines having concentric or similarly-shaped tub and drum structures, thereby effectively reducing noise caused by rotation of the drum 250 during the spin-drying process of the drum type washing machine 101.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A drum type washing machine comprising:

a cabinet having a vertical cross section with a quadrangular or substantially quadrangular shape;

a tub having one surface that faces upper corners of the cabinet;

a rotatable drum in the tub, and configured to accommodate laundry;

a drying duct configured to supply hot air to the tub; and a hot air providing device in the cabinet, and configured to provide the hot air directly to the drying duct, wherein the hot air providing device comprises a fan and/or a heater, wherein an outer circumference surface of the rotatable drum is surrounded by a surface of the tub, wherein the tub comprises an upper portion and a lower portion, wherein the upper portion has a first volume and the lower portion has a second volume less than the first volume, based on or relative to a rotation center of the drum, wherein the tub has a first upper corner closer to a first upper corner of the cabinet than the drum, and a second upper corner closer to the drum than a second upper corner of the cabinet, and wherein the drying duct is disposed at a curved portion of the second upper corner of the tub and is further configured to improve a drying rate.

2. The drum type washing machine of claim 1, wherein the cabinet has a rectangular or substantially rectangular parallelepiped shape.

3. The drum type washing machine of claim 1, wherein the drum has a cylindrical shape, an open side or end, and a plurality of holes therein configured to allow water and hot air to flow into the drum from the tub.

4. The drum type washing machine of claim 1, wherein the upper portion of the tub has an external part, surface or shape different from an external part, surface or shape of the lower portion of the tub.

5. The drum type washing machine of claim 4, wherein the lower portion of the tub has a cylindrical shape corresponding to a shape of the drum, and the upper portion of the tub has a quadrangular or substantially quadrangular shape corresponding to a shape of the cabinet.

6. The drum type washing machine of claim 1, wherein the drying duct is configured to communicate with the tub.

* * * * *